United States Patent [19]

Bates

[11] 4,202,575

[45] May 13, 1980

[54] DOOR HANDLE MECHANISMS

[75] Inventor: Laurence H. J. Bates, Birmingham, England

[73] Assignee: G. & S. Allgood (Holdings) Limited, London, England

[21] Appl. No.: 844,090

[22] Filed: Oct. 20, 1977

[30] Foreign Application Priority Data

Oct. 22, 1976 [GB] United Kingdom ..... 44043/76

[51] Int. Cl.[2] ..... E05C 13/00

[52] U.S. Cl. ..... 292/347

[58] Field of Search ..... 292/244, 347, 350, 169

[56] References Cited

U.S. PATENT DOCUMENTS

| | | | |
|---|---|---|---|
| 2,313,840 | 3/1943 | Pleasant et al. | 292/347 X |
| 4,042,268 | 8/1977 | Coglan | 292/347 |

FOREIGN PATENT DOCUMENTS

| | | | |
|---|---|---|---|
| 480364 | 2/1938 | United Kingdom | 292/347 |
| 813707 | 5/1959 | United Kingdom | 292/347 |
| 937696 | 9/1963 | United Kingdom | 292/347 |
| 1305269 | 1/1973 | United Kingdom | 292/347 |

*Primary Examiner*—Richard E. Moore

*Attorney, Agent, or Firm*—Ladas, Parry, Von Gehr, Goldmith & Deschamps

[57] ABSTRACT

A door handle mechanism including a handle and a mounting plate, comprising a housing secured against rotation relatively to the mounting plate, the housing containing a torsion spring, engaged between the housing and part of the handle extending within the housing, and a stop plate secured on the handle part co-operable with the housing to limit handle rotation and the stop plate serving also to enclose the spring within the housing.

6 Claims, 6 Drawing Figures

DOOR HANDLE MECHANISMS

This invention relates to mechanisms for door handles and including spring means for returning the handle to a predetermined position with respect to a mounting plate, the object of the invention being to provide such a mechanism in which the depth occupied by the mechanism is minimised, though reliable operation is assured.

According to the present invention there is provided a door handle mechanism including a handle and a mounting plate, comprising a housing secured against rotation relatively to the mounting plate and containing a torsion spring, of which one end is located in the housing and the other end is located in a part of the handle projecting into and rotatable within the housing, said part of the handle carrying a stop plate non-rotatably engaged therewith, and said stop plate co-operating with the housing to limit rotation of the handle therein and the stop plate also serving to enclose the spring within the housing and means being provided for securing the stop plate onto the said part of the handle.

Figure 1:
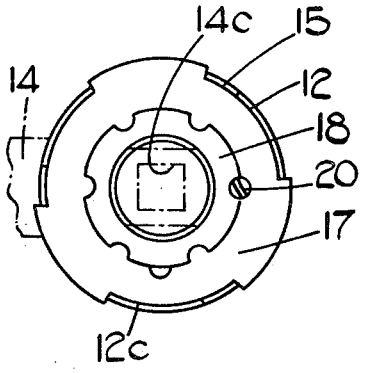
Figure 2:
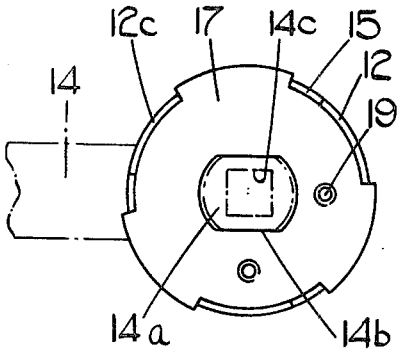
Figure 3:
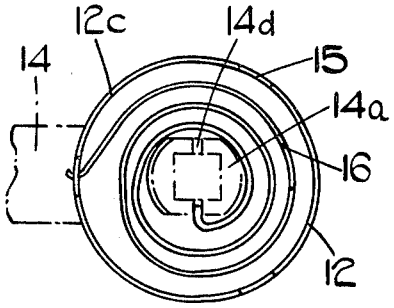
Figure 4:
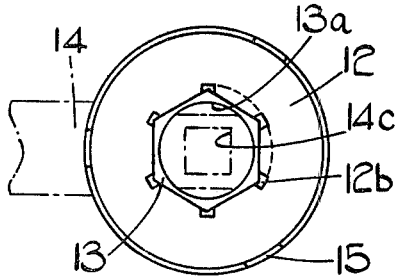
Figure 5:
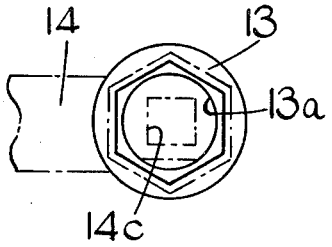
Figure 6:
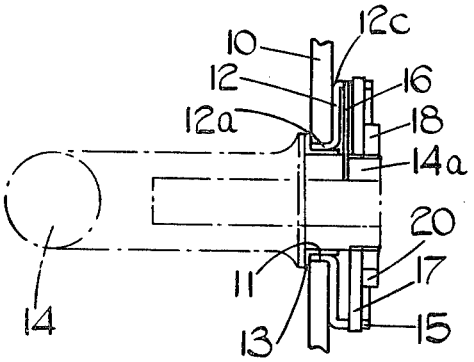

The invention will now be described, by way of example, with reference to the accompanying drawings, in which:

FIG. 1 is a plan view of the rear of the mechanism constructed in accordance with the invention, FIG. 2 is a similar view with the lock nut removed, FIG. 3 is a similar view with the lock nut and stop plate removed, FIG. 4 is again a similar view with the lock nut, stop plate and spring removed, FIG. 5 shows the end of the handle and FIG. 6 is a side elevation cross-sectional view of the mechanism.

The mechanism is designed for use with a flat mounting plate which is indicated at 10 in FIG. 6. The mounting plate thickness is typically 10 Standard Wire Gauge. This mounting plate has a hexagonal hole 11 therein, in which is engaged part of a housing 12. Said part of the housing is a shallow hexagon shaped spigot 12*a* locating in the correspondingly shaped hole in the plate 10. This spigot is both internally and externally hexagon shaped and as shown in FIG. 4, the internal corners of the hexagon are relieved at 12*b*. This arrangement is created by forming the housing 12 as a pressing in which the centre is pressed out to form six ears which together define the hexagonal spigot 12*a*. The relieving at the corners at 12*b* also provides clearance for a washer 13 located therein. The washer 13 is therefore of hexagon shape externally but has a cylindrical bore 13*a*. The washer 13 is also provided at one axial end with an annular flange.

Journalled in the circular bore 13*a* of the washer is a spigot 14*a* which is of circular section but with two opposed flats 14*b*. Within the handle 14 is a square section bore 14*c* to receive a spindle (not illustrated) of a latch mechanism fitted within a door to which the mounting plate 10 may be secured. As shown in FIG. 3, the spigot 14*a* has, at its extremity, two opposed slots 14*d*, the purpose of which will be referred to later.

The housing 12 is of generally cylindrical configuration having a flat portion surrounding the spigot 12*a* and a shallow external flange 12*c* on which are three spaced projections 15. These projections 15 are equiangularly spaced about the centre of the housing and form respective abutments. Contained within the housing is a torsion spring 16. One end of the torsion spring engages in one of the slots 14*d* in the handle spigot 14*a*, such end of the spring being shorter than the slot so as not to protrude into the square section bore 14*c* in the spigot.

The other end of the torsion spring engages in a hole in the flange 12*c* of the housing 12. There are two such holes (not shown in the drawing) located at the positions of two of the projections 15 of the housing flange. The spring is of square section wire and may be fitted either way up. In the position shown it is designed to provide a spring force acting in a clockwise direction whereas with the spring turned over and its outer end engaged in the other of the two holes, anti-clockwise bias is produced.

Enclosing the spring and forming an end for the housing is a circular stop plate 17. This has three external equally spaced lobes which engage over the flange 12*c* of the housing. Angular movement of the stop plate is limited by engagement of the lobes with the projections 15. The arrangement of three lobes and three projections provides a balance for the stop plate, resisting any tendency for it to tilt.

To secure the stop plate 17 in place, it has a hole of a shape to accept the flat-sided circular spigot 14*a* of the handle as shown in FIG. 2. Furthermore, the end of the spigot is screw-threaded externally to receive a lock nut 18 which secures the stop plate against the housing. However, the lock nut is positioned to allow relative rotation between the stop plate and the housing but with minimum clearance between them. The lock nut 18 has spaced notches and the stop plate has two radially spaced screw holes 19, in one of which a screw 20 is fitted. The arrangement is such that the correct clearance of the stop plate from the housing flange can be selected with one screw 20 occupying one of the holes 19. The 90° spacing of the holes 19 and the 60° spacing of the notches in the lock nut 18 provides for fine adjustment of the nut.

An alternative arrangement for securing the stop plate on to the end of the spigot 14*a* of the handle is a spring clip with the end of the spigot being spun over to locate it and retain it in place.

I claim:

1. A door handle mechanism comprising a mounting plate intended for securement, in use, to a door, means defining a non-circular aperture through said mounting plate, a housing disposed at one side of the mounting plate, the housing having non-circular formations thereon engaging in said non-circular aperture non-rotatably to mount the housing relative to the mounting plate and to define a further non-circular aperture through said housing, a washer non-rotatably engaged in said further aperture and having a circular internal bore therethrough, a handle having a part projecting through said circular bore into said housing and being rotatable therein, a torsion spring having first and second ends, the first end being located in the housing and the second end being located in said part of the handle, a stop plate non-rotatably carried by said part of the handle and cooperating with the housing to limit rotation of the handle and also serving to enclose said torsion spring within the housing, and means for securing the stop plate onto said part of the handle.

2. A door handle mechanism as claimed in claim 1, wherein said housing is formed with three projections and the stop plate is formed with three lobes thereon to engage, in use, with said projections to limit rotation of said handle.

3. A door handle mechanism as claimed in claim 2, wherein the torsion spring has its first end engaged in a hole in a selected one of said projections and its second end in a correspondingly selected one of a pair of opposed slots in said part of the handle.

4. A door handle mechanism as claimed in claim 1, wherein the means for securing the stop plate onto said part of the handle comprises a nut and screw means provided for engagement in a selected one of a number of alternative openings in the stop plate and for engagement with said nut, to provide alternative locked positions of the nut.

5. A door handle mechanism comprising a handle, a mounting plate intended for securement, in use, to a door, a housing secured against rotation relatively to the mounting plate, a torsion spring contained in the housing, the torsion spring having a first end located in the housing and a second end located in a part of said handle projecting into and rotatable within the housing, said part of the handle carrying a stop plate non-rotatably engaged therewith, said stop plate serving to enclose said spring within the housing, means being provided to secure the stop plate onto said part of the handle, and at least three projections being formed on the housing, at least three abutments on the stop plate cooperating with said projections thereby to limit rotation of said stop plate and thus rotation of said handle.

6. A door handle mechanism as claimed in claim 5, in which three equiangularly spaced projections are provided on the housing, and thee similarly equi-angularly spaced lobes are formed on the stop plate, to engage, in use, with said projections to limit rotation of the handle.

* * * * *